US008241081B2

(12) United States Patent
Hao et al.

(10) Patent No.: US 8,241,081 B2
(45) Date of Patent: Aug. 14, 2012

(54) METHOD FOR MAKING FIELD EMISSION CATHODE DEVICE

(75) Inventors: Hai-Yan Hao, Beijing (CN); Peng Liu, Beijing (CN); Jie Tang, Beijing (CN); Yang Wei, Beijing (CN); Liang Liu, Beijing (CN); Kai-Li Jiang, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 74 days.

(21) Appl. No.: 12/900,602

(22) Filed: Oct. 8, 2010

(65) Prior Publication Data

US 2011/0237148 A1 Sep. 29, 2011

(30) Foreign Application Priority Data

Mar. 25, 2010 (CN) ..... 2010 1 0132350

(51) Int. Cl.
*H01J 17/49* (2006.01)

(52) U.S. Cl. ..... 445/24; 313/495

(58) Field of Classification Search ..... 445/24–25; 313/495–497

See application file for complete search history.

(56) References Cited

U.S. PATENT DOCUMENTS

2006/0175950 A1* 8/2006 Itou et al. ..... 313/311

* cited by examiner

*Primary Examiner* — Anne Hines
(74) *Attorney, Agent, or Firm* — Altis Law Group, Inc.

(57) ABSTRACT

A method for making a field emission cathode device is presented. First, an insulative substrate is provided. The insulative substrate includes a first surface and a second surface opposite to the first surface. The insulative substrate defines a number of openings extending through from the first surface to the second surface. Second, at least one electron emitter is provided corresponding to each of the number of openings. The electron emitter includes a fixing portion and an electron emission portion connecting to the fixing portion. The fixing portion is fixed on the first surface, and the electron emission portion extends from the fixing portion into the number of openings. Third, a number of cathode electrodes are formed on the first surface to fix the fixing portion between the insulative substrate and the cathode electrodes.

19 Claims, 15 Drawing Sheets

METHOD FOR MAKING FIELD EMISSION CATHODE DEVICE

RELATED APPLICATIONS

This application claims all benefits accruing under 35 U.S.C. §119 from China Patent Application No. 201010132350.5, filed on Mar. 25, 2010 in the China Intellectual Property Office, the contents of which are hereby incorporated by reference.

BACKGROUND

1. Technical Field

The present disclosure relates to a method for making field emission cathode device.

2. Description of Related Art

Field emission displays (FEDs) are a new, rapidly developing flat panel display technology. Generally, FEDs can be roughly classified into diode and triode structures. In particular, carbon nanotube-based FEDs have attracted much attention in recent years.

Field emission cathode devices are important elements in FEDs. A method for making field emission cathode device usually includes the steps of: providing an insulating substrate; forming a cathode electrode on the substrate; forming a dielectric layer on the cathode electrode; forming a plurality of holes on the dielectric layer to expose the cathode electrode; forming a plurality of carbon nanotubes on the exposed cathode electrode. Usually, the carbon nanotubes are fabricated on the cathode electrode by chemical vapor deposition (CVD). However, the carbon nanotubes fabricated by CVD are not secured on the cathode electrode. Thus, the carbon nanotubes tend to be pulled out from the cathode electrode by a strong electric field force causing the field emission cathode device to have a short lifespan.

What is needed, therefore, is a method for making field emission cathode device that can overcome the above-described shortcomings.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

References will now be made to the drawings to describe, in detail, various embodiments of the present method for making field emission cathode device. The field emission cathode device can be applied to a diode FEDs or a triode FEDs.

Referring to FIGS. 1 to 6, a method for making a field emission cathode device 100 of one embodiment includes the following steps of:

step (a), providing an insulative substrate 110, wherein the insulative substrate 110 includes a first surface 1106 and a second surface 1104 opposite to the first surface 1106, the insulative substrate 110 defines a plurality of openings 1102 extending through from the first surface 1106 to the second surface 1104;

step (b), disposing at least one electron emitter 1402 corresponding to one or more of the plurality of openings 1102, wherein the electron emitter 1402 includes a fixing portion 1404 and an electron emission portion 1406 connected to the fixing portion 1404, the fixing portion 1404 is fixed on the first surface 1106, and the electron emission portion 1406 extends from the fixing portion 1404 into the openings 1102;

step (c), forming a plurality of strip-shaped cathode electrodes 120 on the first surface 1106 to fix the fixing portion 1404 between the insulative substrate 110 and the cathode electrodes 120.

Figure 7:
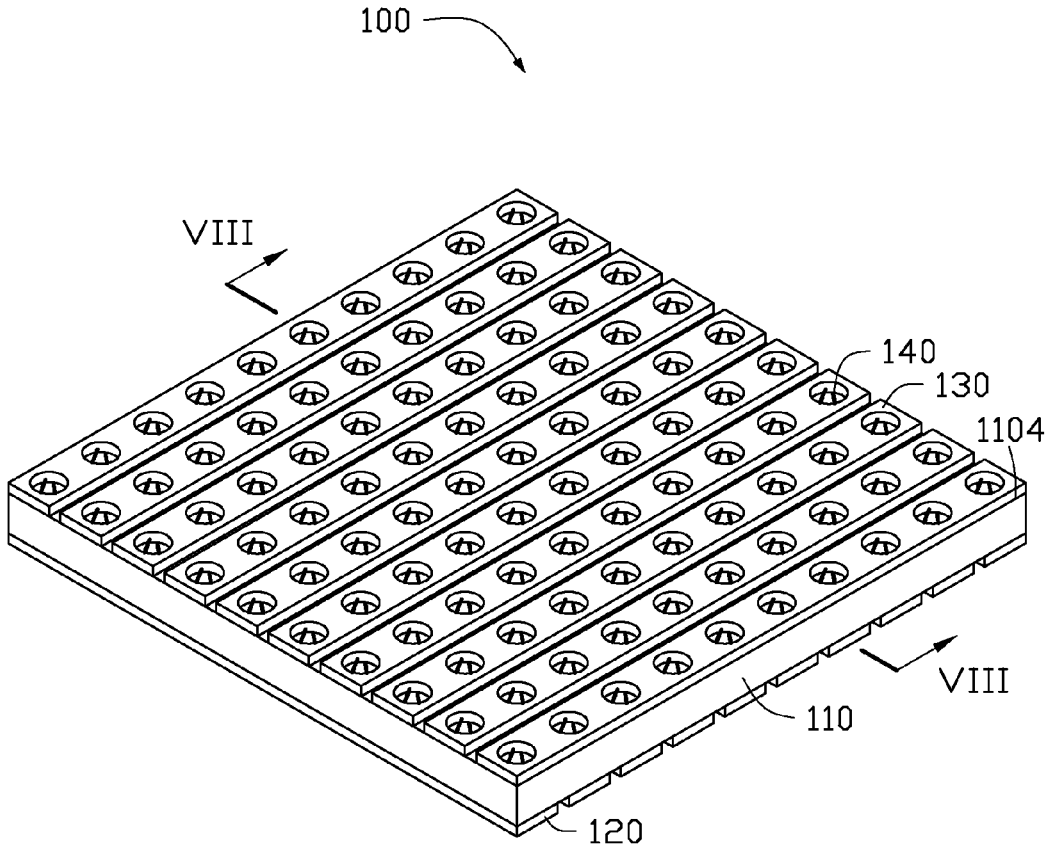
FIG. 7 is a schematic view of a field emission cathode device made by the method of FIGS. 1-6.

In step (a), the insulative substrate 110 can be made of insulative material. The insulative material can be ceramics, glass, resins, quartz, or polymer. A size, a shape and a thickness of the insulative substrate 110 can be chosen according to need. The insulative substrate 110 can be square plate or rectangular plate with a thickness greater than 15 micrometers. The openings 1102 can be arranged in an array or according to a certain pattern. A diameter of each opening 1102 can range from about 3 micrometers to about 100 micrometers. In one embodiment, the insulative substrate 110 is a square polymer plate with a thickness of about 1 millimeter, an edge length of about 50 millimeters. The openings 1102 are arranged in a matrix as shown in FIG. 7, and the number of the openings 1102 is 10×10 (10 rows, 10 openings 1102 on each row). The diameter of each opening 1102 is about 50 micrometers.

In step (b), the electron emitter 1402 should be flexible and free standing. The electron emitter 1402 can be a linear carbon nanotube structure, a carbon fibre, or a silicon nanowire. The electron emitter 1402 can be located substantially parallel or twisted with at least one supporting wire. A diameter of the supporting wire can range from about 50 micrometers to about 500 micrometers. The supporting wire can be a metal wire such as copper wire, aluminum wire, silver wire, molybdenum wire, or gold wire. The supporting wire is used to support the electron emitter 1402 so that it has a good free standing property.

In one embodiment, the electron emitter 1402 is a linear carbon nanotube structure. The linear carbon nanotube structure can include at least one carbon nanotube wire and/or at least one carbon nanotube cable. A carbon nanotube cable includes two or more carbon nanotube wires. The carbon nanotube wires in the carbon nanotube cable can be, twisted or untwisted. In an untwisted carbon nanotube cable, the carbon nanotube wires are substantially parallel with each other. In a twisted carbon nanotube cable, the carbon nanotube wires are twisted with each other. A diameter of the linear carbon nanotube structure can range from about 1 micrometer to about 500 micrometers. In one embodiment, the diameter of the linear carbon nanotube structure is 20 micrometers.

The carbon nanotube wire can be untwisted or twisted. The untwisted carbon nanotube wire can be obtained by treating a drawn carbon nanotube film, drawn from a carbon nanotube array with a volatile organic solvent. Examples of drawn carbon nanotube film, also known as carbon nanotube yarn, or nanofiber yarn, ribbon, and sheet are taught by U.S. Pat. No. 7,045,108 to Jiang et al., and WO 2007015710 to Zhang et al. Specifically, the organic solvent is applied to soak the entire surface of the drawn carbon nanotube film. During the soaking, adjacent parallel carbon nanotubes in the drawn carbon nanotube film will bundle together, due to the surface tension of the organic solvent as it volatilizes, and thus, the drawn carbon nanotube film will be shrunk into untwisted carbon nanotube wire. The untwisted carbon nanotube wire includes a plurality of carbon nanotubes substantially oriented along a same direction (i.e., a direction along the length of the untwisted carbon nanotube wire). The carbon nanotubes are parallel to the axis of the untwisted carbon nanotube wire. More specifically, the untwisted carbon nanotube wire includes a plurality of successive carbon nanotube segments joined end to end by van der Waals attractive force therebetween. Each carbon nanotube segment includes a plurality of carbon nanotubes substantially parallel to each other, and joined by van der Waals attractive force therebetween. The carbon nanotube segments can vary in width, thickness, uniformity and shape. Length of the untwisted carbon nanotube wire can be arbitrarily set as desired. A diameter of the untwisted carbon nanotube wire can range from about 0.5 nanometers to about 100 micrometers. Examples of carbon nanotube wire are taught by US PGPub. 20070166223A1 to Jiang et al.

The twisted carbon nanotube wire can be formed by twisting the drawn carbon nanotube film using a mechanical force to turn the two ends of the drawn carbon nanotube film in opposite directions. The twisted carbon nanotube wire includes a plurality of carbon nanotubes helically oriented around an axial direction of the twisted carbon nanotube wire. More specifically, the twisted carbon nanotube wire includes a plurality of successive carbon nanotube segments joined end to end by van der Waals attractive force therebetween. Each carbon nanotube segment includes a plurality of carbon nanotubes parallel to each other, and joined by van der Waals attractive force therebetween. Length of the carbon nanotube wire can be set as desired. A diameter of the twisted carbon nanotube wire can be from about 0.5 nanometers to about 100 micrometers. Further, the twisted carbon nanotube wire can be treated with a volatile organic solvent after being twisted. After being soaked by the organic solvent, the adjacent paralleled carbon nanotubes in the twisted carbon nanotube wire will bundle together, due to the surface tension of the organic solvent when the organic solvent is volatilizing. The specific surface area of the twisted carbon nanotube wire will decrease, while the density and strength of the twisted carbon nanotube wire will be increased. The carbon nanotubes in the carbon nanotube wire can be single-walled, double-walled, or multi-walled carbon nanotubes.

In one embodiment, the step (b) can include the following substeps of:

step (b1), providing a field emission wire supply device 200 configured for supplying a continuous field emission wire 1408, wherein the field emission wire supply device 200 includes a hollow needle 202 having a tip 204, the field emission wire 1408 extends through the hollow needle 202 and one end of the field emission wire 1408 extends out from the tip 204;

step (b2), moving the hollow needle 202, inserting the hollow needle 202 into each of the plurality of openings 1102 consecutively, and supplying the field emission wire 1408 continuously at the same time so a portion of the field emission wire 1408 is fixed on the first surface 1106 and a portion of the field emission wire 1408 is located in each of the openings 1102;

step (b3), severing the field emission wire 1408 to obtain at least one electron emitter 1402.

In step (b1), an smallest inner diameter of the hollow needle 202 can be selected according to the diameter of the field emission wire 1408, and an outer diameter of the hollow needle 202 can be selected according to the diameter of the opening 1102. The inner diameter of the hollow needle 202 can be about 5 times to about 10 times of the diameter of the field emission wire 1408. Thus, the friction between the field emission wire 1408 and the hollow needle 202 can be reduced. The field emission wire 1408 can extend out from the tip 204 continuously. The field emission wire supply device 200 can further include a robot arm (not shown), a control computer (not shown) and other auxiliary equipment to automate the continuous production. In one embodiment, the field emission wire 1408 is a linear carbon nanotube structure that can be cut to form a plurality of electron emitters 1402.

Figure 1:
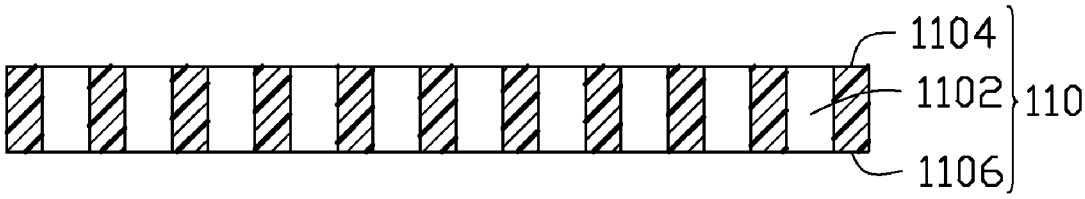
FIGS. 1-6 show processes of one embodiment of a method for making a field emission cathode device.
Figure 2:
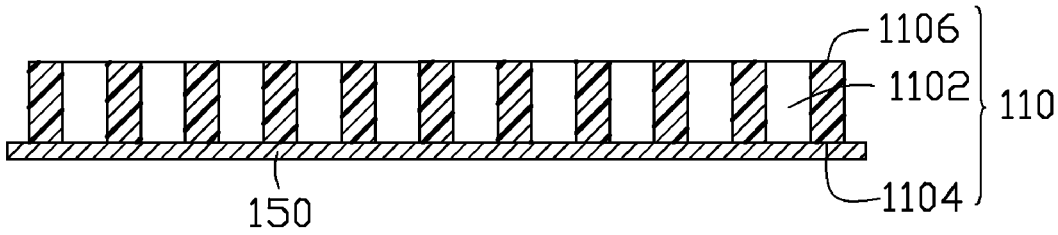
Figure 3:
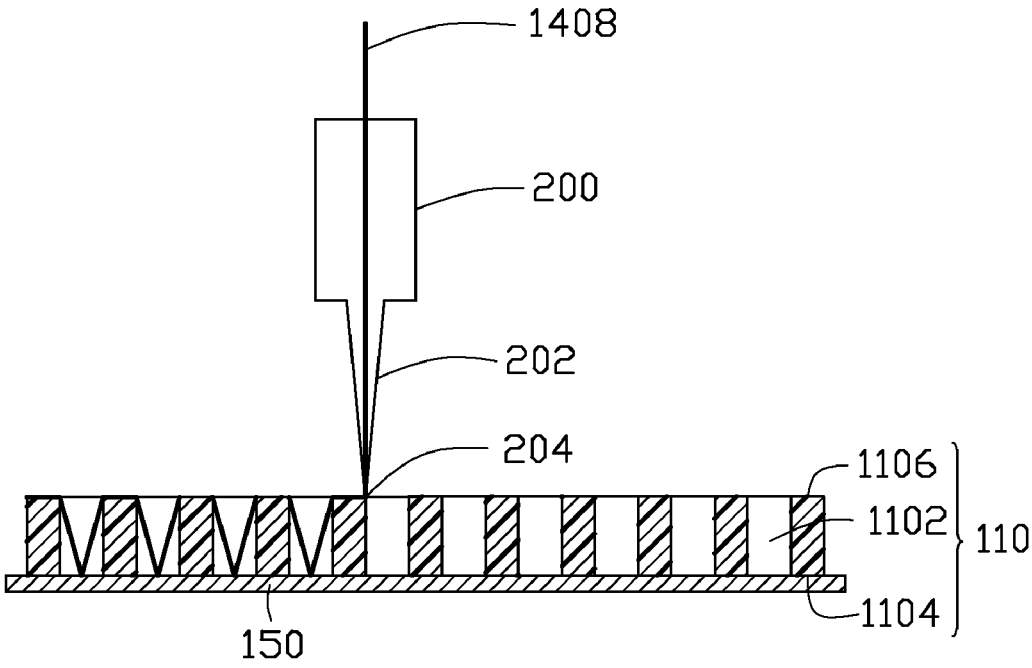
Figure 4:
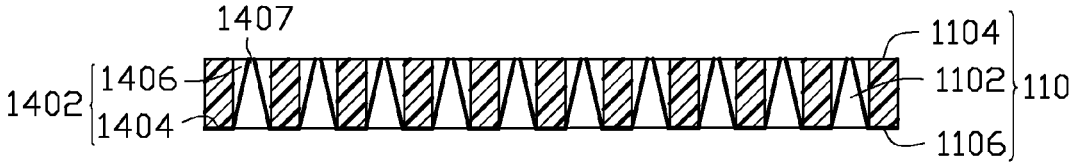

Referring to FIGS. 2 to 4, two electron emitters 1402 are disposed in each opening 1102 in one embodiment, and step (b2) includes the following substeps of:

step (b21), providing a fixing element 150 on a side adjacent to the second surface 1104;

step (b22), fixing the end of the field emission wire 1408 from the tip 204 on the first surface 1106;

step (b23), moving the hollow needle 202 along a direction substantially parallel to the first surface 1106 to at least one opening 1102;

step (b24), inserting the hollow needle 202 into the at least one opening 1102 so that the field emission wire 1408 extends along the direction substantially parallel to the first surface 1106 and into the at least one opening 1102, and is held by the fixing element 150;

step (b25), pulling the hollow needle 202 out of the opening 1102;

step (b26), moving the hollow needle 202 along the direction substantially parallel to the first surface 1106 so that the field emission wire 1408 extends out of the at least one opening 1102 and along the direction substantially parallel to the first surface 1106, thus a portion of the field emission wire 1408, located in the opening 1102 forms a V shape;

step (b27), repeating the steps (b23) to (b26) so that the field emission wire 1408 is disposed corresponding to each of the openings 1102, and the portion of the field emission wire 1408 located in each opening 1102, forms a V shape.

In step (b21), the fixing element 150 is configured to fix the field emission wire 1408 so that the field emission wire 1408 is fixed in the opening 1102. The fixing element 150 can be a sheet or a hook. The sheet can be an adhesive tape, a plastic film, or a glass plate coated with binder. When the fixing element 150 is a plurality of hooks, the plurality of hooks can be arranged on a plate with each of the hooks corresponding to one of the openings 1102. The hook can hold the field emission wire 1408 without polluting the field emission wire 1408. In one embodiment, the fixing element 150 is a plastic film. The plastic film can contact and cover all the openings 1102 with a viscid surface adjacent to the second surface 1104.

In step (b22), the end of the field emission wire 1408 extends from the tip 204 can be fixed on the first surface 1106 by a binder. In addition, the end of the field emission wire 1408 can be fixed on the first surface 1106 with other fixing devices.

In step (b24), the field emission wire 1408 can be bonded on a plastic film.

In step (b26), the portion of the field emission wire 1408 substantially parallel to the first surface 1106 can be fixed on the first surface 1106 because the field emission wire 1408 is taut. The V shaped portion of the field emission wire 1408 is located in the opening 1102 with the point being located in a central axis of the opening 1102.

In step (b27), the hollow needle 202 can be moved continuously so that the field emission wire 1408 is located corresponding to each of the openings 1102. Furthermore, the field emission wire 1408 should be cut from a position on the first surface 1106 and between adjacent two openings 1102. In one embodiment, a laser scan can be performed along the row and/or column of the openings 1102.

In step (b3), the field emission wire 1408 can be cut by a method of mechanical cutting such as a blade, laser scanning, electron beam irradiation, ion beam irradiation, heating by supplying a current, and/or laser-assisted fusing after supplying current.

In one embodiment, step (b3) includes the following substeps of: step (31), removing the fixing element 150;

step (32), cutting the field emission wire 1408.

In step (32), the V shaped field emission wire 1408 is cut by laser scan to form two electron emission portions 1406. Each electron emission portion 1406 has an electron emission end 1407. Furthermore, laser can treat the electron emission ends 1407 to remove the impurities. Thus, the work function of the electron emission ends 1407 can be decreased.

As shown in FIG. 4, two electron emitters 1402 are disposed in each opening 1102 in one embodiment. The fixing portion 1404 of each electron emitter 1402 is fixed on the first surface 1106. The electron emission portion 1406 of each electron emitter 1402 slantingly extends from cathode electrodes 120 to a center of the opening 1102. The electron emitters 1402 in the same row or same column can be kept in connection.

Figure 9:
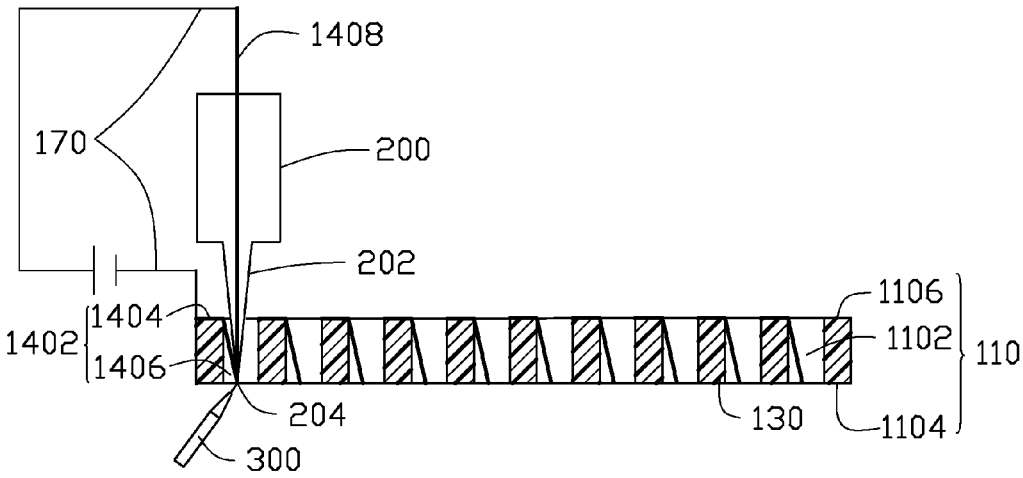
FIG. 9 is a schematic view of disposing a linear carbon nanotube structure of one embodiment of a method for making a field emission cathode device.
Figure 10:
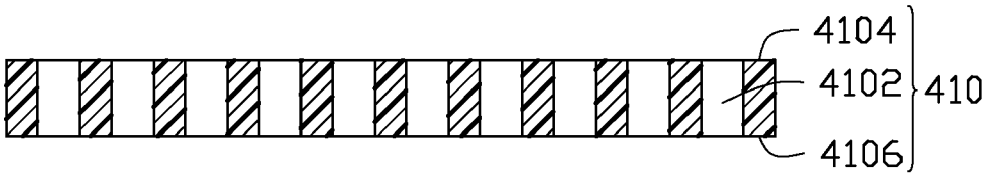
FIGS. 10-15 show processes of one embodiment of a method for making a field emission cathode device.
Figure 11:
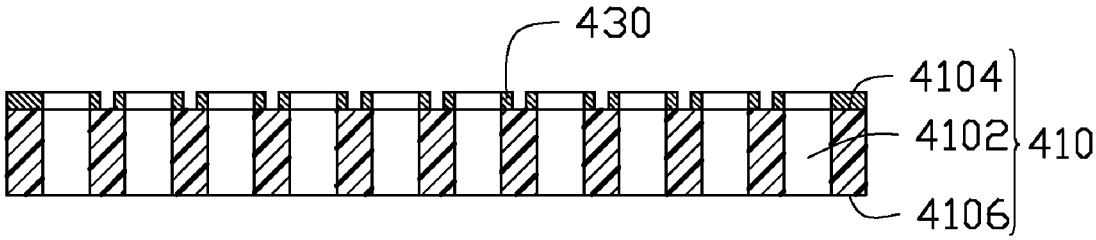
Figure 12:
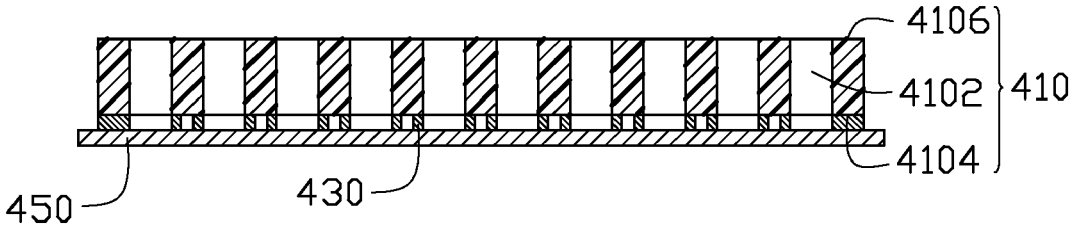

Referring to FIG. 9, only one electron emitters 1402 is disposed in each opening 1102 in one embodiment, and step (b2) includes the following substeps of:

step (b21), fixing the end of the field emission wire 1408 extending from the tip 204 on the first surface 1106;

step (b22), moving the hollow needle 202 along a direction substantially parallel to the first surface 1106 to one opening 1102;

step (b23), inserting the hollow needle 202 into the opening 1102;

step (b24), cutting the portion of the field emission wire 1408 to obtain one electron emitter 1402;

step (b25), repeating the step (b21) to (b24) so each of the openings 1102 has one electron emitter 1402 disposed therein.

In step (b24), two ends of the field emission wire 1408 are electrically connected to a power (not labeled) by two wires 170 as shown in FIG. 9. A current is supplied to the field emission wire 1408 and a laser 300 is used to irradiate the field emission wire 1408. The field emission wire 1408 is sliced at a position where the laser 300 irradiates. In one embodiment, the field emission wire 1408 is a linear carbon nanotube structure, and the electron emission end 1407 of the electron emitter 1402 is a tooth-shaped structure. The number of the graphite layers of the carbon nanotubes of the electron emission ends 1407 is less than 5.

Figure 5:
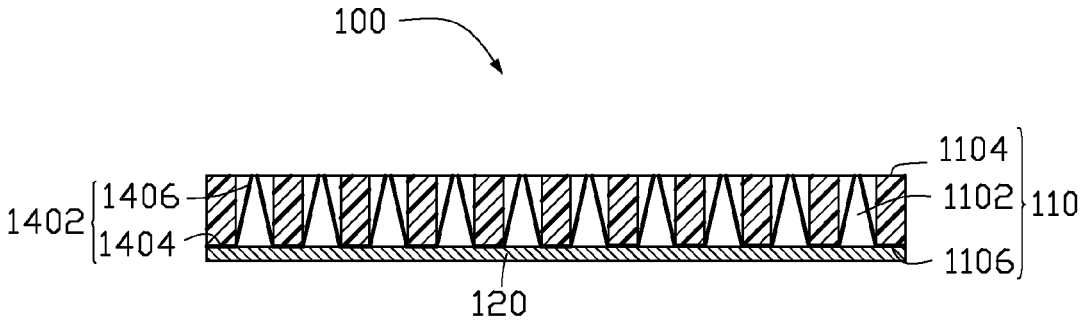

In step (c), the plurality of strip-shaped cathode electrodes 120 is formed substantially parallel to each other. Each of the cathode electrodes 120 is formed corresponding to a same row or a same column of openings 1102. The cathode electrode 120 contacts the electron emitter 1402 so that they are electrically connected. The cathode electrodes 120 can be made of metal, alloy, conductive slurry, or indium tin oxide (ITO). The metal can be copper, aluminum, gold, silver or iron. The conductive slurry can include from about 50% to about 90% (by weight) of the metal powder, from about 2% to about 10% (by weight) of the glass powder, and from about 8% to about 40% (by weight) of the binder. The cathode electrodes 120 can be made by a method of screen printing, electroplating, chemical vapor deposition, magnetron sputtering, heat deposition, or directly fixing a metal sheet. In one embodiment, the cathode electrodes 120 are made by directly fixing strip-shaped copper sheets on the first surface 1106. The strip-shaped copper sheets are coated with binder. As shown in FIG. 5, the copper sheet covers the opening 1102 and fixes the fixing portion 1404 between the insulative substrate 110 and the cathode electrodes 120.

Figure 6:
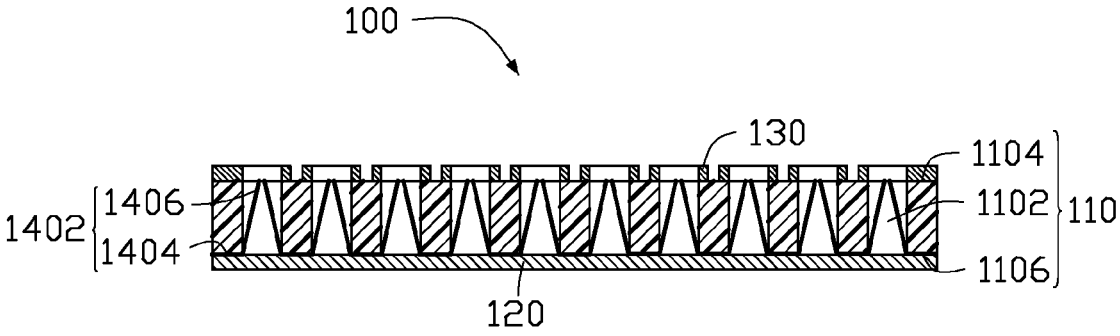

As shown in FIG. 6, an optional step (d) of forming a plurality of strip-shaped gate electrodes 130 on the second surface 1104 can be performed after step (c). Thus, the field emission cathode device 100 can be applied to a triode FEDs. As shown in FIG. 7, the plurality of strip-shaped gate electrodes 130 is located substantially parallel to each other. Alignment directions of the cathode electrodes 120 intersect alignment directions of the gate electrodes 130. The extending direction of the cathode electrodes 120 can be substantially perpendicular to the extending direction of the gate electrodes 130. Each of the electron emitters 1402 can be controlled by the one of the cathode electrodes 120, and one of the gate electrodes 130 and electrons can be independently emitted.

The gate electrodes 130 can be made of material the same as the material of the cathode electrodes 120. A plurality of through holes (not labeled) can be defined by the gate electrodes 130 and be in alignment with the openings 1102. A diameter of each hole can range from about 1 micrometer to about 1000 micrometers. Each of the through holes corresponds to one of the openings 1102 so that the electron emitters 1402 can be exposed. In one embodiment, the gate electrodes 130 are strip-shaped conductive films made by screen printing conductive slurry. The diameter of each hole is 500 micrometers.

Figure 8:
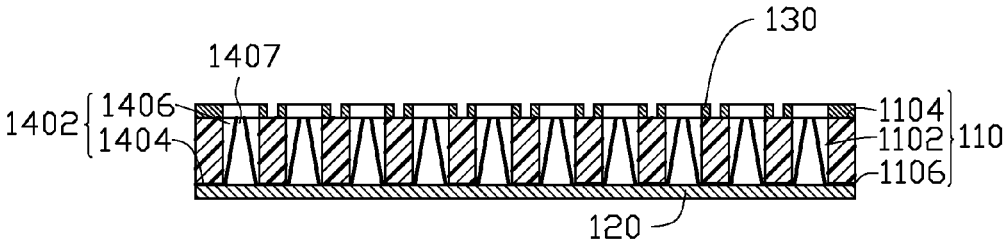
FIG. 8 is a schematic, cross-sectional view, along a line VIII-VIII of FIG. 7.

Referring to FIGS. 7 and 8, the field emission cathode device 100 made in one embodiment includes an insulative substrate 110, a plurality of cathode electrodes 120, a plurality of gate electrodes 130 and a plurality of electron emission units 140.

The cathode electrodes 120 are substantially parallel to each other and located at the first surface 1106. The gate electrodes 130 are substantially parallel to each other and located on the second surface 1104. Alignment directions of the cathode electrodes 120 intersect alignment directions of the gate electrodes 130. The extending direction of the cathode electrodes 120 can be substantially perpendicular to the extending direction of the gate electrodes 130. Each of the electron emission units 140 corresponds to one of the openings 1102 and is electrically connected to one corresponding cathode electrode 120. Each opening 1102 is covered by one of corresponding cathode electrodes 120. At least one portion of each electron emission unit 140 is fixed between the insulative substrate 110 and the corresponding cathode electrodes 120. Each of the electron emission units 140 is controlled by the one of the cathode electrodes 120, and one of the gate electrodes 130 and electrons can be independently emitted. The electron emission portion 1406 of each electron emitter 1402 aslant extends from cathode electrodes 120 to a center of the opening 1102. The two electron emission ends 1407 are spaced from each other.

Each of the electron emission units 140 includes two electron emitters 1402. The fixing portion 1404 of each electron emitter 1402 is fixed between the insulative substrate 110 and the corresponding cathode electrode 120.

In the field emission cathode device 100, the fixing portion 1404 of each electron emitter 1402 is fixed between the insulative substrate 110 and the cathode electrodes 120. Thus, the electron emission units 140 are secured and cannot be pulled out from the cathode electrode 120 by electric field force in a strong electric field. The field emission cathode device 100 has a long life.

Referring to FIGS. 10 to 15, a method for making a field emission cathode device 400 of one embodiment includes the following steps of:

step (a), providing an insulative substrate 410, wherein the insulative substrate 410 includes a first surface 4106 and a second surface 4104 opposite to the first surface 4106, the insulative substrate 410 defines a plurality of openings 4102 extending through from the first surface 4106 to the second surface 4104;

step (b), forming a plurality of strip-shaped gate electrodes 430 on the second surface 4104;

step (c), disposing at least one electron emitter 4402 corresponding to one or more of the plurality of openings 4102, wherein the electron emitter 4402 includes a fixing portion 4404 and an electron emission portion 4406 connected to the fixing portion 4404, the fixing portion 4404 is fixed on the first surface 4106, and the electron emission portion 4406 extends from the fixing portion 4404 into the openings 4102;

step (d), forming one or more strip-shaped cathode electrodes 420 on the first surface 4106, the fixing portion 4404 is located between the insulative substrate 410 and the cathode electrodes 420.

Figure 13:
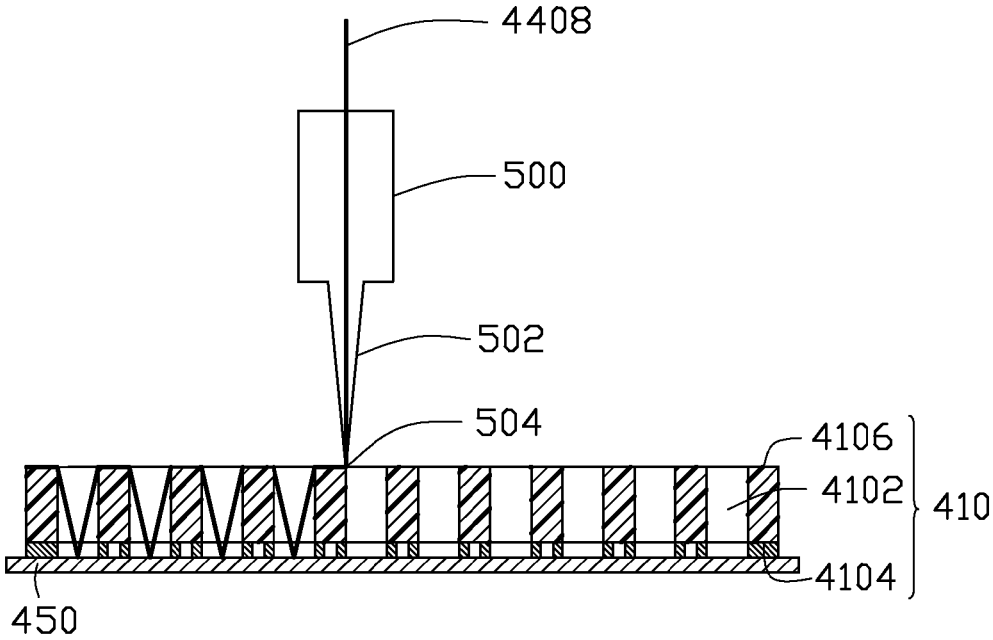
Figure 14:
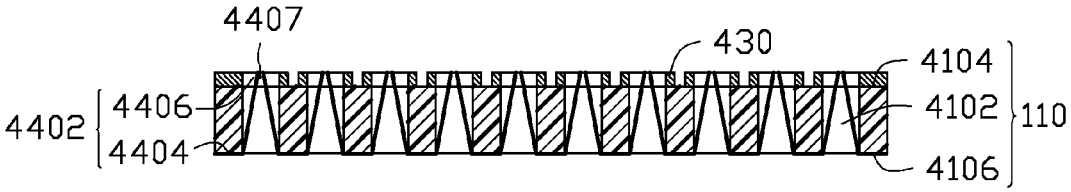
Figure 15:
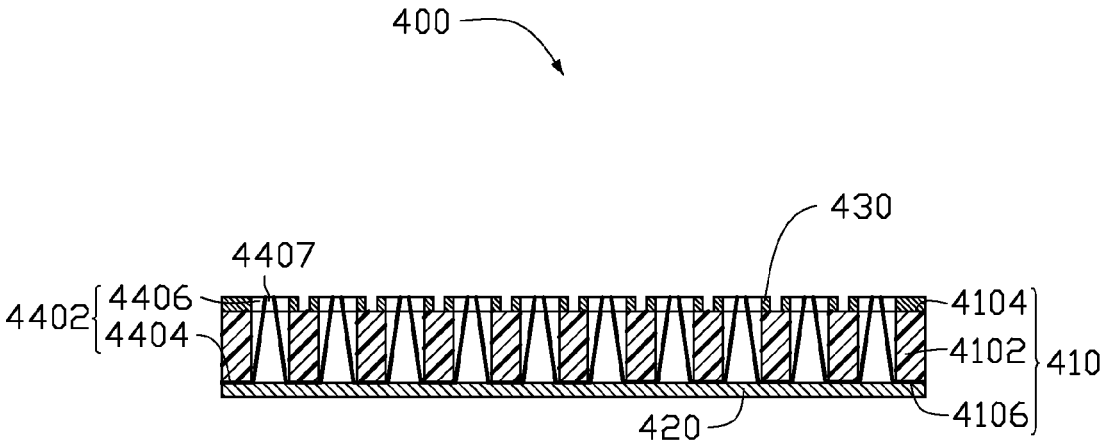

In step (c), as shown in FIGS. 13 to 15, two electron emitters 4402 are disposed in each opening 4102 by the following steps of:

step (c1), providing a fixing element 450, and disposing the fixing element 450 on;

step (c2), fixing the end of the field emission wire 4408 extending from a tip 504 of a field emission wire supply device 500 on the first surface 4106;

step (c3), moving a hollow needle 502 of the field emission wire supply device 500 along a direction substantially parallel to the first surface 4106 to at least one opening 4102, and then inserting the hollow needle 502 into the at least one opening 4102 so that the field emission wire 4408 extends along a direction substantially parallel to the first surface 4106 firstly and then extends into the at least one opening 4102, and is held by the fixing element 450;

step (c4), pulling the hollow needle 502 out of the opening 4102, and then moving the hollow needle 502 along a direction substantially parallel to the first surface 4106 so that the field emission wire 4408 extends out of the at least one opening 4102 first and then extends along a direction substantially parallel to the first surface 4106, thus a portion of the field emission wire 4408 located in the opening 4102 forms a V shape;

step (c5), repeating the steps (c1) to (c4) so that the field emission wire 4408 is disposed corresponding to each of the openings 4102, and a portion of the field emission wire 4408 located in each opening 4102 forms a V shape;

step (c6), removing the fixing element 450, and cutting the portion of the field emission wire 4408 located in each opening 4102 to obtain two electron emitters 4402.

The gate electrodes 430 are formed before disposing the electron emitter 4402, therefore, the electron emitter 4402 will not be polluted by the step of forming gate electrodes 430 by the method of depositing or screen printing. Furthermore, a distance between a top surface (not labeled) of the gate electrodes 130 and an electron emission end 4407 of the electron emission portion 4406 can be kept less than 5 micrometers by selecting the position where the field emission wire 4408 is cut. Thus, the controlling voltage of the gate electrodes 130 can be in a range from about 30 volts to about 100 volts. In one embodiment, the distance between the top surface of the gate electrodes 130 and the electron emission end 4407 is less than 2 micrometers so that the control voltage of the gate electrodes 130 can be in a range from about 70 volts to about 80 volts. Thus, the electron emitter 4402 has a low control voltage, and can save energy.

Depending on the embodiment, certain of the steps of methods described may be removed, others may be added, and the sequence of steps may be altered. It is also to be understood that the description and the claims drawn to a method may include some indication in reference to certain steps. However, the indication used is only to be viewed for identification purposes and not as a suggestion as to an order for the steps.

It is to be understood that the above-described embodiments are intended to illustrate rather than limit the disclosure. Any elements described in accordance with any embodiments is understood that they can be used in addition or substituted in other embodiments. Embodiments can also be used together. Variations may be made to the embodiments without departing from the spirit of the disclosure. The above-described embodiments illustrate the scope of the disclosure but do not restrict the scope of the disclosure.

What is claimed is:

1. A method for making a field emission cathode device, comprising the following steps:

step (a), providing an insulative substrate, wherein the insulative substrate comprises a first surface and a second surface opposite to the first surface, and the insulative substrate defines one or more openings extending through from the first surface to the second surface;

step (b), disposing at least one electron emitter corresponding to one of the one or more openings, wherein the at least one electron emitter comprises a fixing portion and an electron emission portion connected to the fixing portion, the fixing portion is fixed on the first surface, and the electron emission portion extends from the fixing portion into one of the one or more openings, wherein step (b) comprises the following substeps of:

step (b1), providing a field emission wire supply device that is configured for supplying a continuous field emission wire, wherein the field emission wire supply device comprises a hollow needle having a tip, the continuous field emission wire extends through the hollow needle, and one end of the continuous field emission wire extends out from the tip;

step (b2), inserting the hollow needle into each of the one or more openings in turn, and supplying the continuous field emission wire continuously at the same time so as the fixing portion of the continuous field emission wire to be fixed on the first surface and the electron emission portion of the continuous field emission wire to be located in one of the one or more openings; and step (b3), severing the continuous field emission wire; and step (c), forming at least one cathode electrode on the first surface, wherein the fixing portion is located between the insulative substrate and the at least one cathode electrode.

2. The method of claim 1, wherein the at least one electron emitter is flexible and free standing.

3. The method of claim 1, wherein the at least one electron emitter is a linear carbon nanotube structure, a carbon fibre, or a silicon nanowire.

4. The method of claim 1, wherein an inner diameter of the hollow needle is about 5 times to about 10 times a diameter of the continuous field emission wire.

5. The method of claim 1, wherein step (b2) comprises the following substeps of:

step (b21), providing a fixing element;

step (b22), fixing one end of the continuous field emission wire on the first surface;

step (b23), moving the hollow needle along a first direction substantially parallel to the first surface to one of the one or more openings;

step (b24), inserting the hollow needle into one of the one or more openings so that the continuous field emission wire extends along the first direction firstly and into the opening, thereby being held by the fixing element;

step (b25), pulling the hollow needle out of the opening; and step (b26), moving the hollow needle along the first direction so that the continuous field emission wire extends out of the opening firstly and along the first direction, whereby a V-shaped portion of the continuous field emission wire is located in the opening.

6. The method of claim 5, wherein the fixing element comprises a viscid surface or a hook.

7. The method of claim 6, wherein the fixing element is a plastic film.

8. The method of claim 7, wherein the plastic film contacts the second surface and covers the one or more openings.

9. The method of claim 5, wherein step (b2) further comprises a step (b27) of repeating the steps (b23) to (b26) so that each of the one or more openings has the continuous field emission wire disposed therein.

10. The method of claim 5, wherein step (b3) comprises the following substeps of:

step (b31), removing the fixing element; and step (b32), cutting the continuous field emission wire to obtain two electron emission portions in each of the one or more openings, and each of the two electron emission portions has an electron emission end.

11. The method of claim 10, wherein in step (b32), the continuous field emission wire is cut by a method of mechanical cutting, laser scanning, electron beam irradiation, ion beam irradiation, heating by supplying a current, or laser-assisted fusing after supplying current.

12. The method of claim 10, wherein step (b3) further comprise a step (b33) of treating the electron emission end by a laser scanning to remove an impurity.

13. The method of claim 1, wherein step (b2) comprises the following substeps of:

step (b21), fixing one end of the continuous field emission wire on the first surface;

step (b22), moving the hollow needle along a direction substantially parallel to the first surface to one of the one or more openings;

step (b23), inserting the hollow needle into one of the one or more openings so that the fixing portion of the continuous field emission wire to be fixed on the first surface and the electron emission portion of the continuous field emission wire is located in the opening;

step (b24), cutting the continuous field emission wire; and step (b25), repeating the steps (b21) to (b24).

14. The method of claim 13, wherein in step (b24) the continuous field emission wire is cut by supplying a current and assisted with a laser.

15. The method of claim 1, wherein the plurality of cathode electrodes is strip-shaped and substantially parallel to each other, and each of the plurality of cathode electrodes is corresponding to a same row or a same column of the one or more openings.

16. The method of claim 1, further comprising a step (d) of forming one or more gate electrodes on the second surface.

17. A method for making a field emission cathode device, comprising:

step (a), providing an insulative substrate, wherein the insulative substrate comprises a first surface and a second surface opposite to the first surface, and the insulative substrate defines one or more openings extending through from the first surface to the second surface;

step (b), forming a plurality of strip-shaped gate electrodes on the second surface;

step (c), disposing at least one electron emitter into one of the one or more openings, wherein the at least one electron emitter comprises a fixing portion and an electron emission portion connected to the fixing portion, the fixing portion is fixed on the first surface, and the electron emission portion extends from the fixing portion into the one of the one or more openings, and wherein step (c) is performed after step (b); and step (d), forming at least one strip-shaped cathode electrodes on the first surface, the fixing portion is located between the insulative substrate and the at least one cathode strip-shaped electrode.

18. The method of claim 17, wherein step (c) comprises the following substeps of:

step (c1), supplying a continuous linear carbon nanotube structure;

step (c2), disposing the fixing portion of the continuous linear carbon nanotube structure on the first surface, and the electron emission portion of the continuous linear carbon nanotube structure into one of the one or more openings; and step (c3), cutting the continuous linear carbon nanotube structure.

19. The method of claim 18, wherein a distance between a top surface of the at least one strip-shaped gate electrode and an electron emission end of the at least one electron emitter is less than 5 micrometers.

* * * * *